US007145470B2

(12) United States Patent
Hoermann

(10) Patent No.: US 7,145,470 B2
(45) Date of Patent: Dec. 5, 2006

(54) GARAGE DOOR DRIVE WITH LIGHT UNIT

(75) Inventor: Michael Hoermann, Oerlinghausen (DE)

(73) Assignee: Marantec Antriebs- und Steuerungstechnik GmbH & Co. KG, Marienfeld (DE)

( * ) Notice: Subject to any disclaimer, the term of this patent is extended or adjusted under 35 U.S.C. 154(b) by 94 days.

(21) Appl. No.: 10/817,937

(22) Filed: Apr. 6, 2004

(65) Prior Publication Data

US 2004/0246721 A1 Dec. 9, 2004

(30) Foreign Application Priority Data

Apr. 7, 2003 (DE) ..... 203 05 579 U

(51) Int. Cl.
*G08B 5/36* (2006.01)

(52) U.S. Cl. ..... 340/815.49; 318/468; 318/266; 318/286

(58) Field of Classification Search ..... 340/815.49; 318/468, 266, 286
See application file for complete search history.

(56) References Cited

U.S. PATENT DOCUMENTS 3,427,521 A * 2/1969 Goldstein ..... 318/266
5,589,747 A * 12/1996 Utke ..... 318/468

* cited by examiner

*Primary Examiner*—Daryl C Pope
(74) *Attorney, Agent, or Firm*—Crowell & Moring LLP

(57) ABSTRACT

A garage door drive includes a housing and at least one light unit. According to the invention, at least one mounting point for the mechanical and electrical connection of the attachably and detachably constructed at least one light unit is arranged on the housing.

10 Claims, 12 Drawing Sheets

GARAGE DOOR DRIVE WITH LIGHT UNIT

Figure 1:
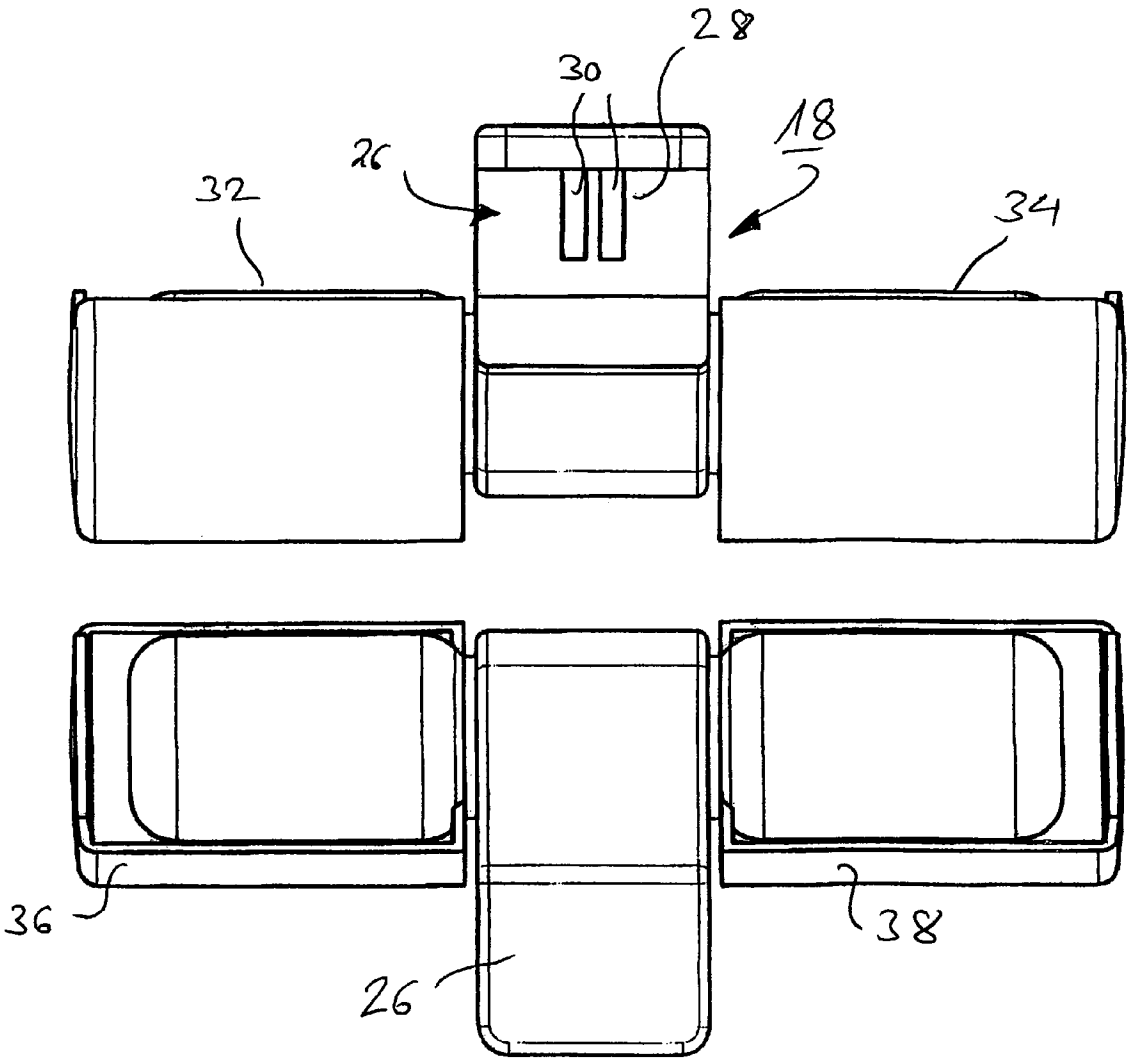
Figure 1:
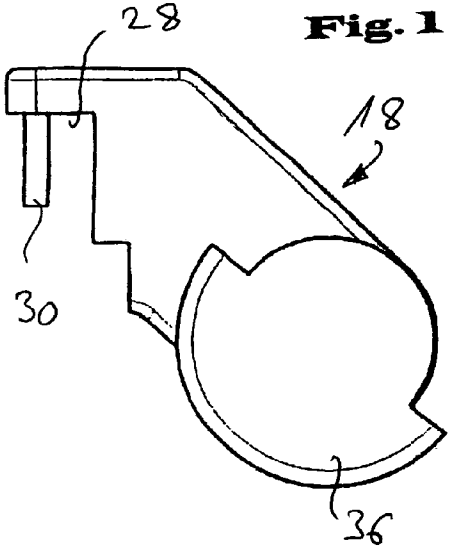

The invention relates to a garage door drive comprising a housing and at least one light unit.

It is already known to combine garage door drives with a light unit to illuminate the garage. In this case, the known light units are generally built into the housing of the garage door drive. For this purpose part of the housing must accordingly have the holders for the lamps and part of the housing must be constructed as a transparent cover. As a result, the overall size of the garage door drive becomes large. As a result of the built-in light unit in the housing, the entire drive is also more expensive. Finally, it is comparatively costly to change defective lamps since the transparent cover must be removed from the housing and the lamp must be unscrewed from the holder in order to replace this with a new lamp.

The object of the invention is thus to construct a generic garage door drive more simply and more cheaply.

This object is solved according to the invention by a generic garage door drive wherein at least one mounting point for the mechanical and electrical connection of the attachably and detachably constructed at least one light unit is arranged on the housing. Here, ready-to-plug-in wiring is thus provided in the housing into which a likewise pre-wired lamp can be plugged in or clicked into position. The garage door drive on the one hand and the light unit on the other hand are thus separated as a structural unit and can be interconnected or separated again from time to time by means of the corresponding mounting point. The garage door drive is hereby combined with differently shaped light units in the fashion of a building block. The light units can hereby be ideally matched to the light conditions in the garage.

Preferred embodiments of the invention are obtained from the dependent claims following the main claim.

Accordingly, respectively at least one locating projection or respectively at least one corresponding locating recess are arranged on the mounting point on the housing side or on the light unit respectively. The corresponding light units are hereby not only attachable but can also be fixedly located whereby any undesirable detachment of the light unit from the housing of the garage door drive is reliably prevented.

Advantageously, the light unit, which can be connected to the aforesaid garage door drive, consists of a central body with a plug connection area and two laterally arranged lamps symmetrically distant from the body. However, any other asymmetric design of light unit is fundamentally possible.

The lamps arranged in the light unit are quite preferably enclosed by reflectors wherein the reflectors are especially advantageously twistable in their position. The light can hereby be focussed and emitted concentrated in a desired direction. Finally, according to another particular embodiment of the invention, the light unit can also have a receiver module with corresponding mounting point. This comprises a separately located module also provided with power supply, which for example, is arranged at a different point in the garage or at another location to be illuminated. By suitably providing such receiver modules it is thus fundamentally also possible to achieve a modular-type system comprising the garage door drive, the receiver module and the respectively attachable light units for optimal illumination of a garage or another room in which the drive device is arranged. The corresponding receiver module can naturally also be arranged in the outside area of a garage or a house.

Further features, details and advantages of the invention are explained in detailed with reference to exemplary embodiments shown in the drawings.

Figure 2:
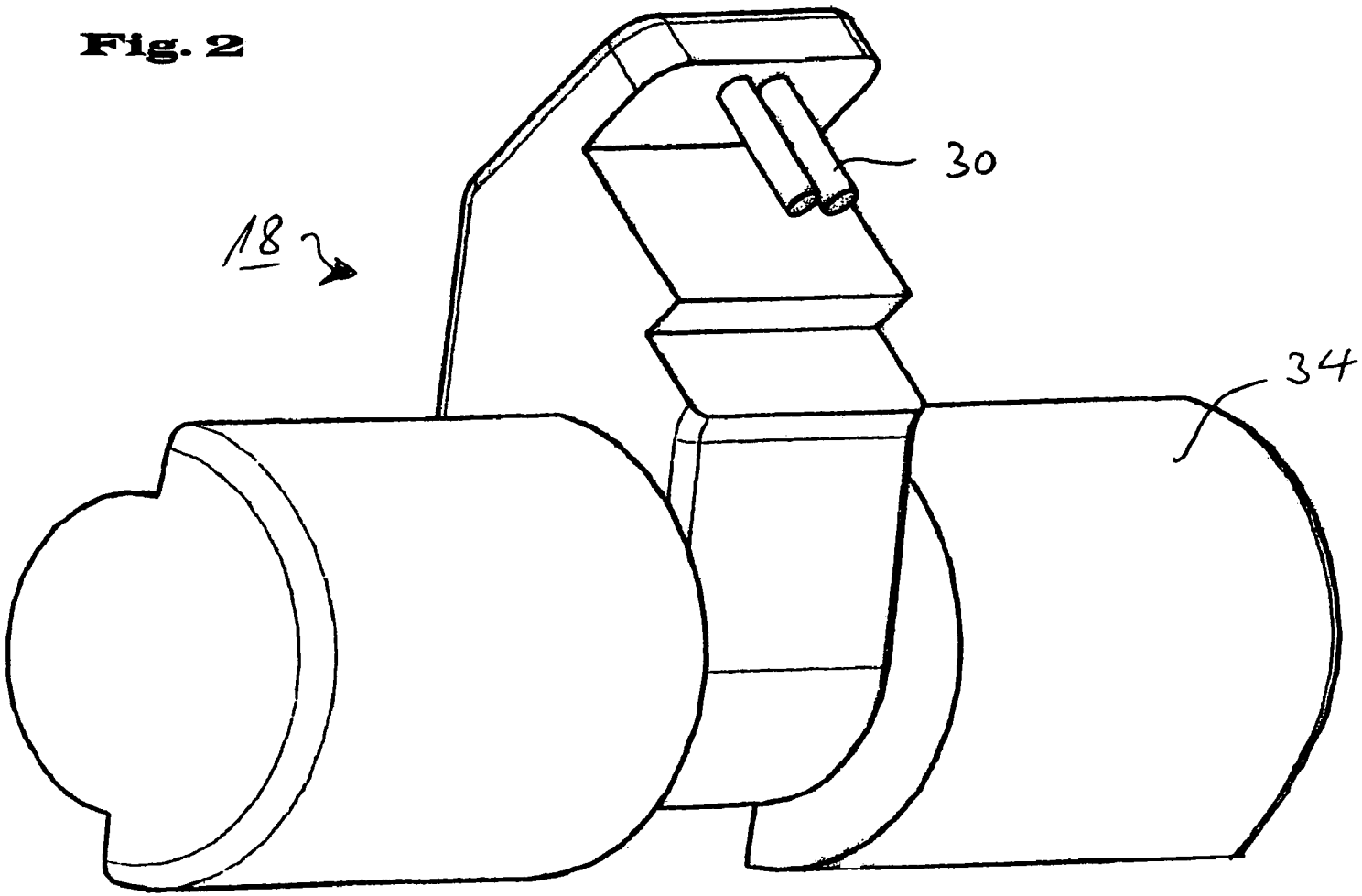
Figure 3:
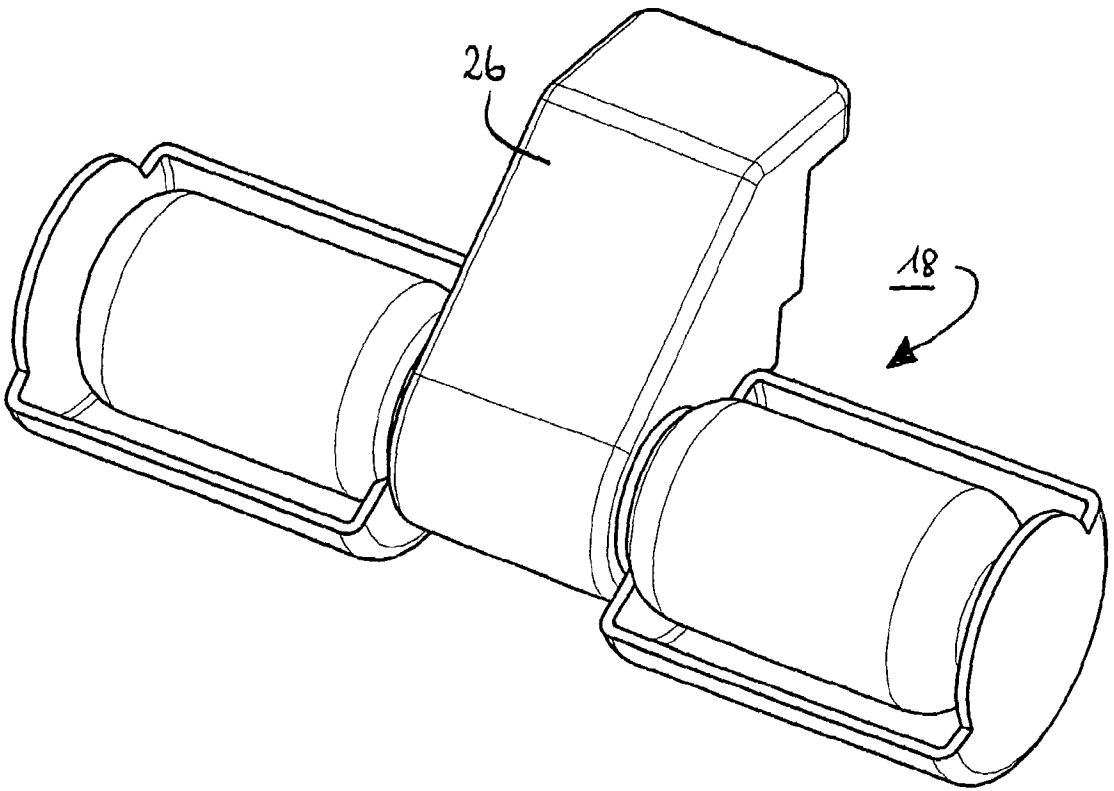
Figure 9:
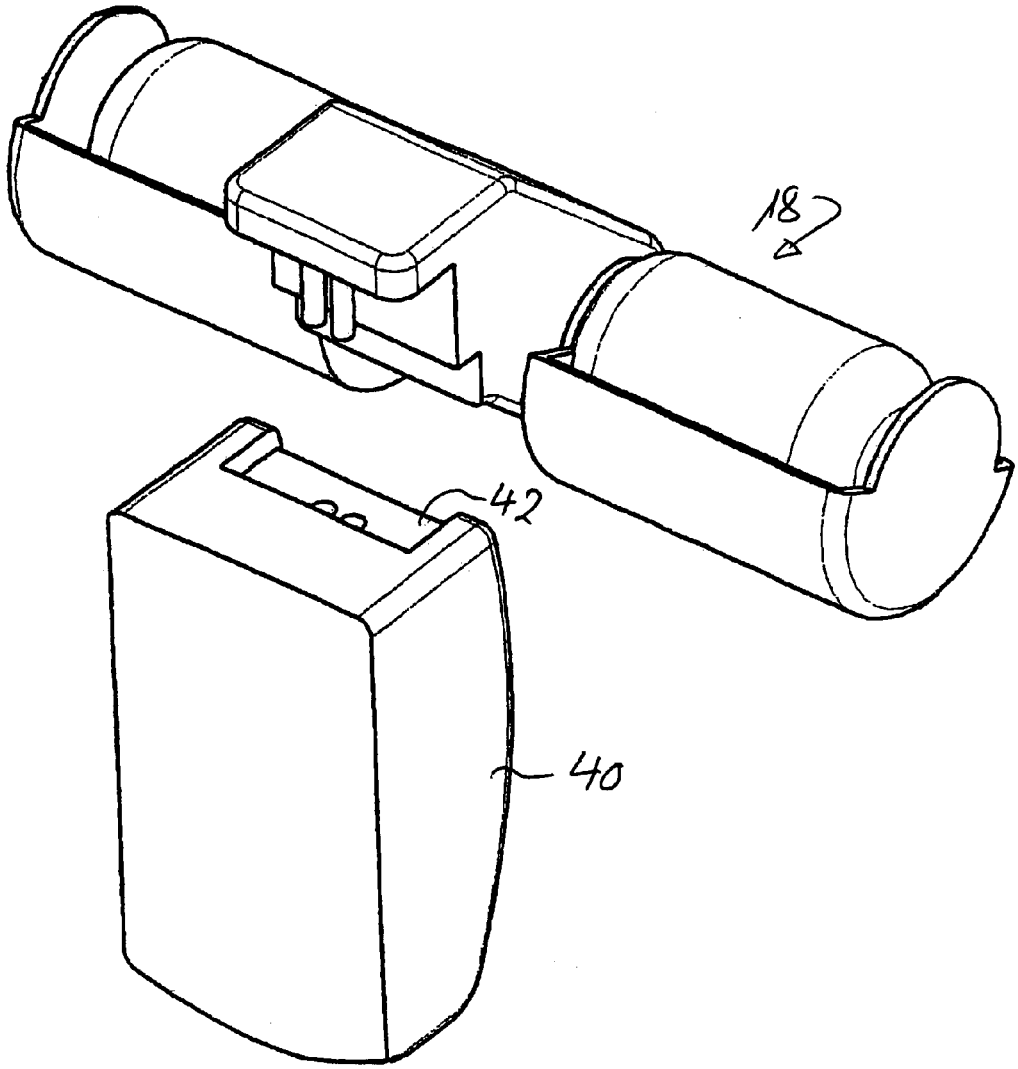
Figure 10:
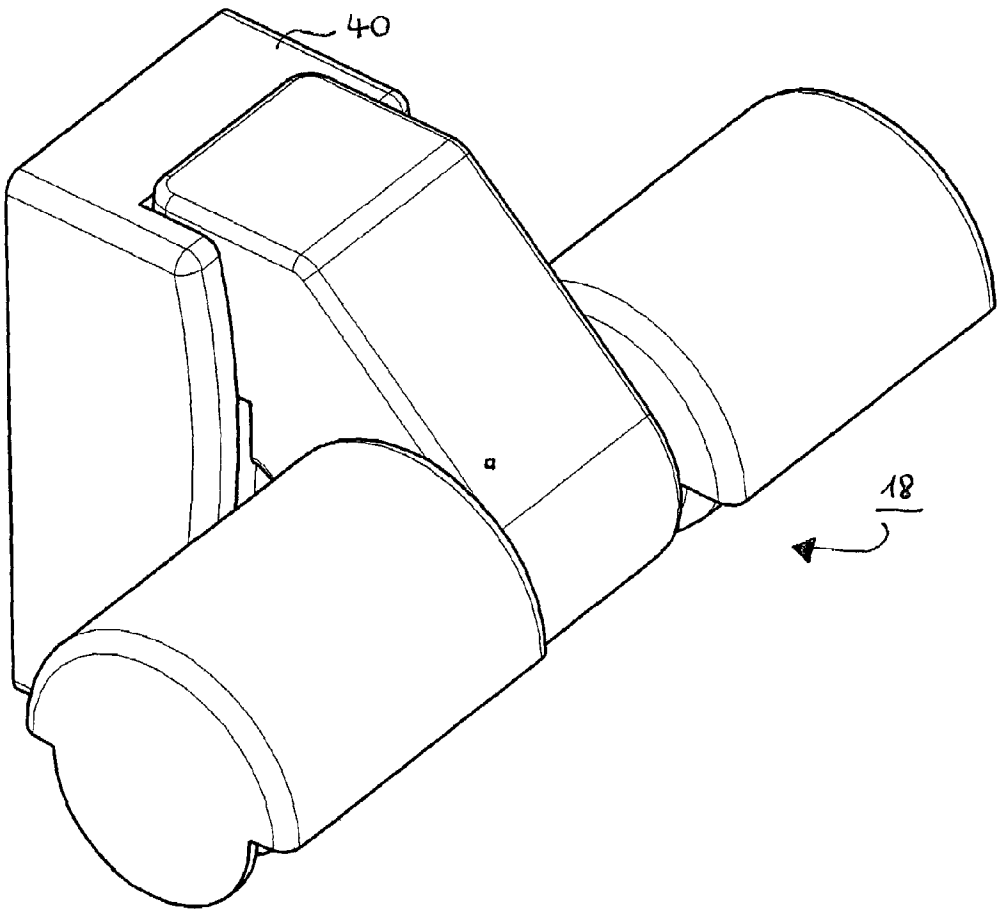
Figure 11:
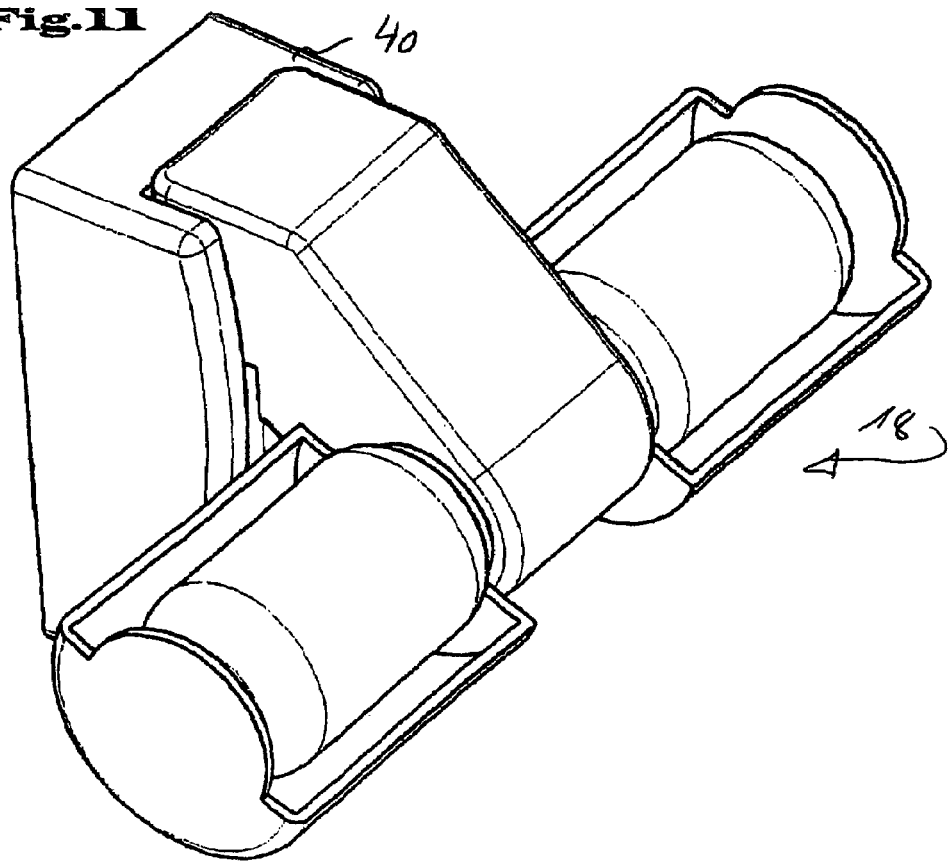
Figure 12:
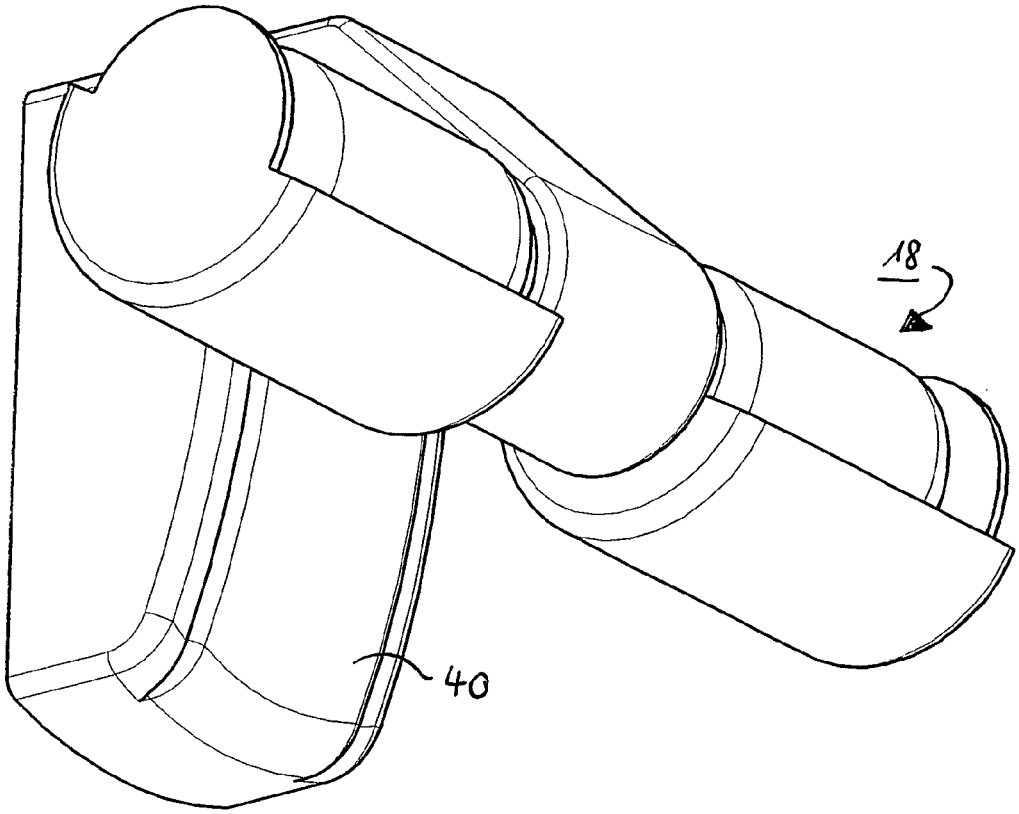

In the figures:

FIG. 1: shows a light unit viewed from the side, from the back and from above, FIG. 2: is a perspective view of the representation from FIG. 1, FIG. 3: is another perspective view of the light unit from FIG. 1, FIG. 4: is a garage door drive with a light unit attached on one side, viewed from above, FIG. 5: shows the garage door drive from FIG. 4 viewed from below, FIG. 6: shows the garage door drive viewed obliquely from above according to another embodiment of the invention, FIG. 7: shows an alternative embodiment of a garage door drive viewed obliquely from below, FIG. 8: shows a perspective view of the garage door drive from FIG. 7 viewed obliquely from above, FIG. 9: shows a receiver module and a light unit shown separately therefrom, FIG. 10: shows a receiver module with a light unit according to a first embodiment in the assembled state, FIG. 11: shows an alternative embodiment to FIG. 10 and FIG. 12: shows the apparatus from FIG. 11 viewed obliquely from below.

Figure 4:
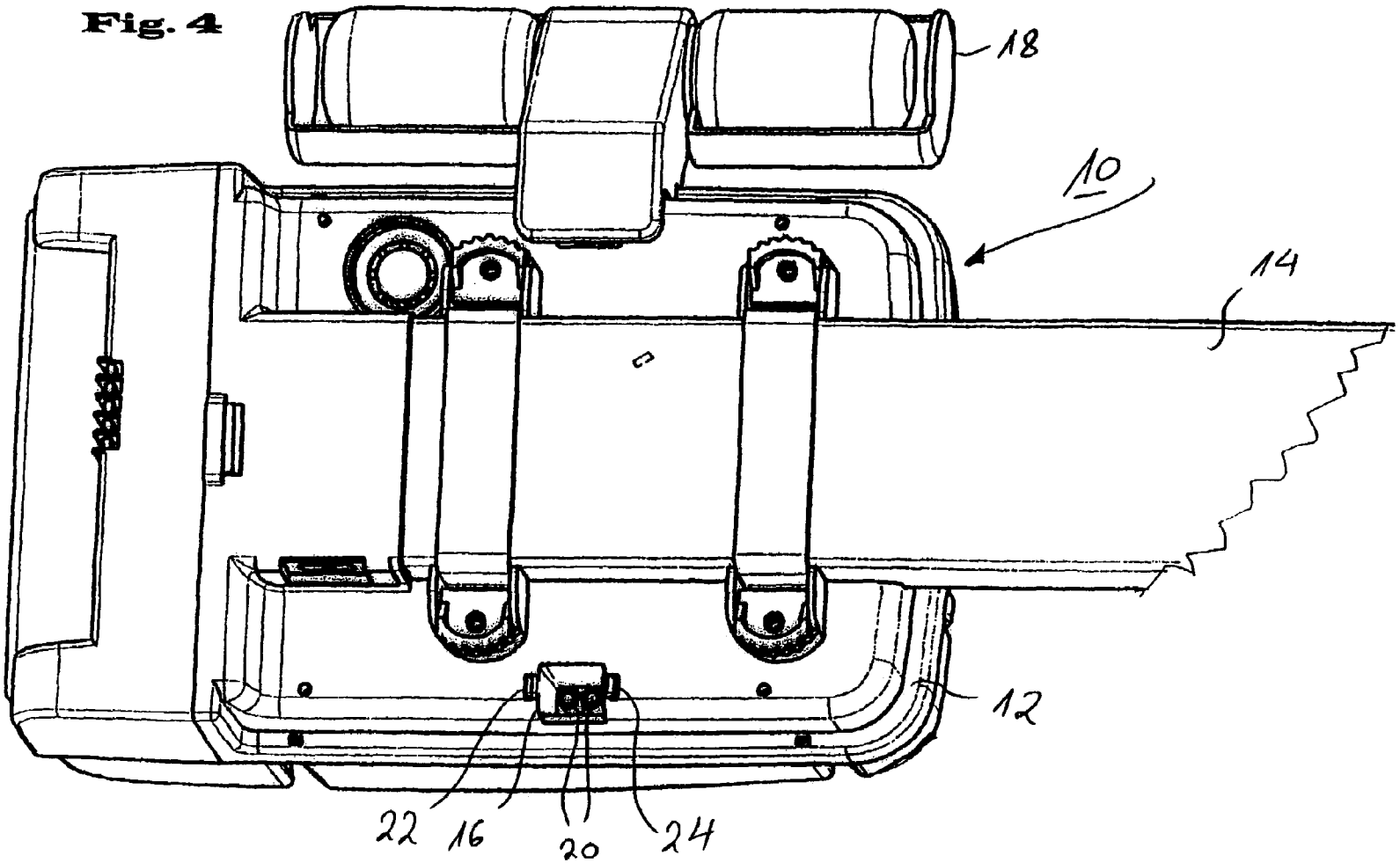

FIG. 4 shows a garage door drive 10 which accommodates a motor, in a fashion not shown in detail, inside a housing 12 and via said motor drives a corresponding tension means, for example a chain, which runs in a sufficiently known fashion in a corresponding C-shaped rail 14. Since garage door drives of this design are largely known, a detailed description is not necessary at this point.

In the area of the housing 12, as shown in FIG. 4, there is a mounting point 16 for a light unit 18, wherein said mounting point 16 has two electrical connecting sleeves 20 and at the side two locating hooks 22 or 24. In the opposite side area of the housing 12, a light unit 18 is placed on the mounting point 16, wherein the locating projections 22 and 24 engage, in a manner not shown in detail here, in corresponding locating recesses (not shown in detail here) on the housing of the light unit 18 and fix the light unit in position. In this case, the locating projections 22 and 24 are elastically constructed and allow the positioned light unit 18 to be released again, wherein a suitably high force must be applied to overcome the locating force applied by the locating projections 22 and 24. The structure of the light unit is especially clear with reference to FIGS. 1 to 2. A light unit 18 consists of a central body 18 with a plug connection area 26, wherein two electrically conducting plugs 30 are provided here which engage in the corresponding sleeves 20 when the light unit 18 is placed on the mounting point 16 on the housing 12. Symmetrically distant lamps 32 and 34 go out from the side of the central body 26. These lamps 32 and 34 are partly surrounded by enclosing reflectors 36 or 38. The reflectors 36 and 38 can be twisted in relation to the lamps 32 and 34 so that the released light beam can emerge focussed at a desired angle.

Figure 5:
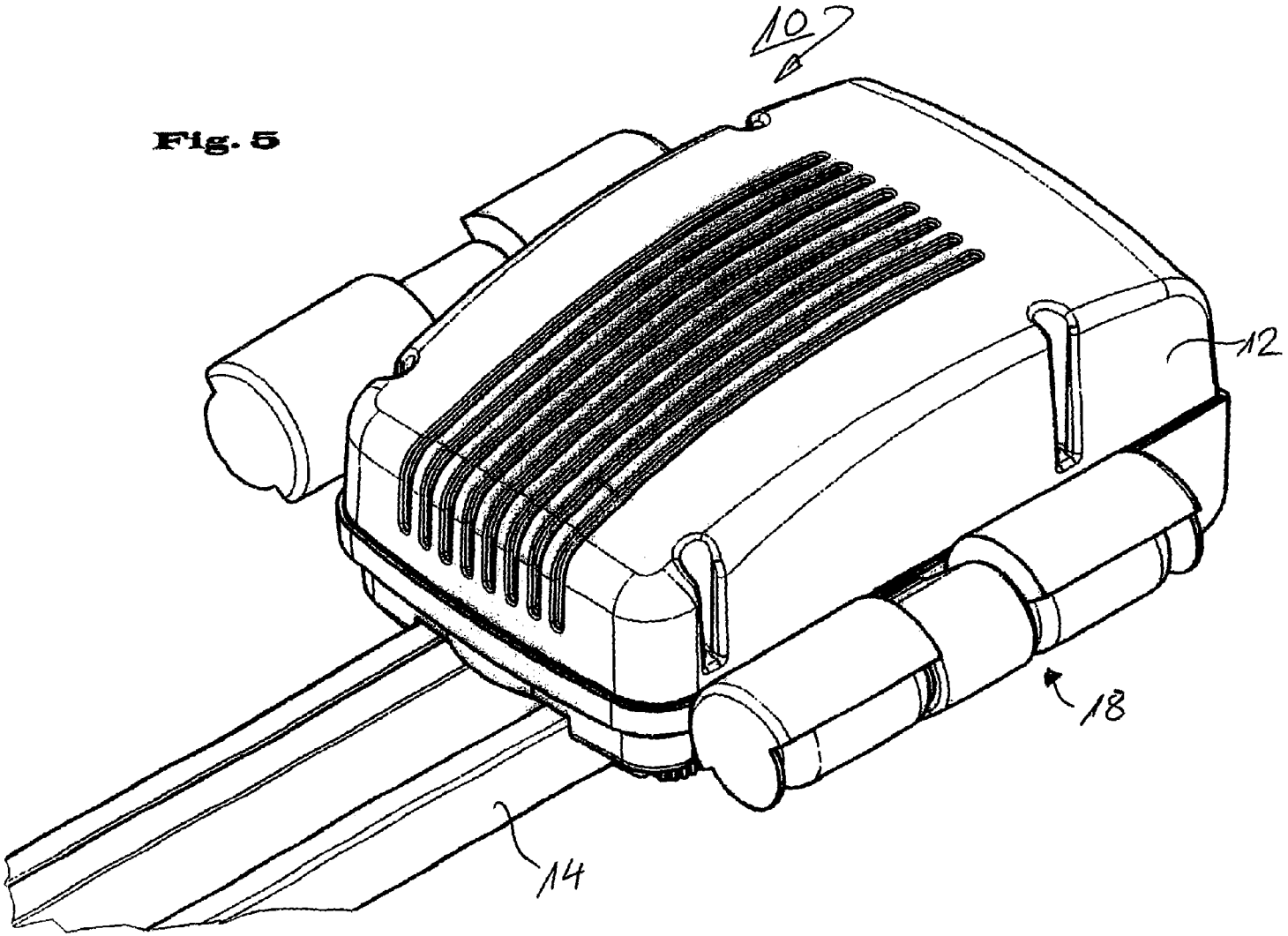
Figure 6:
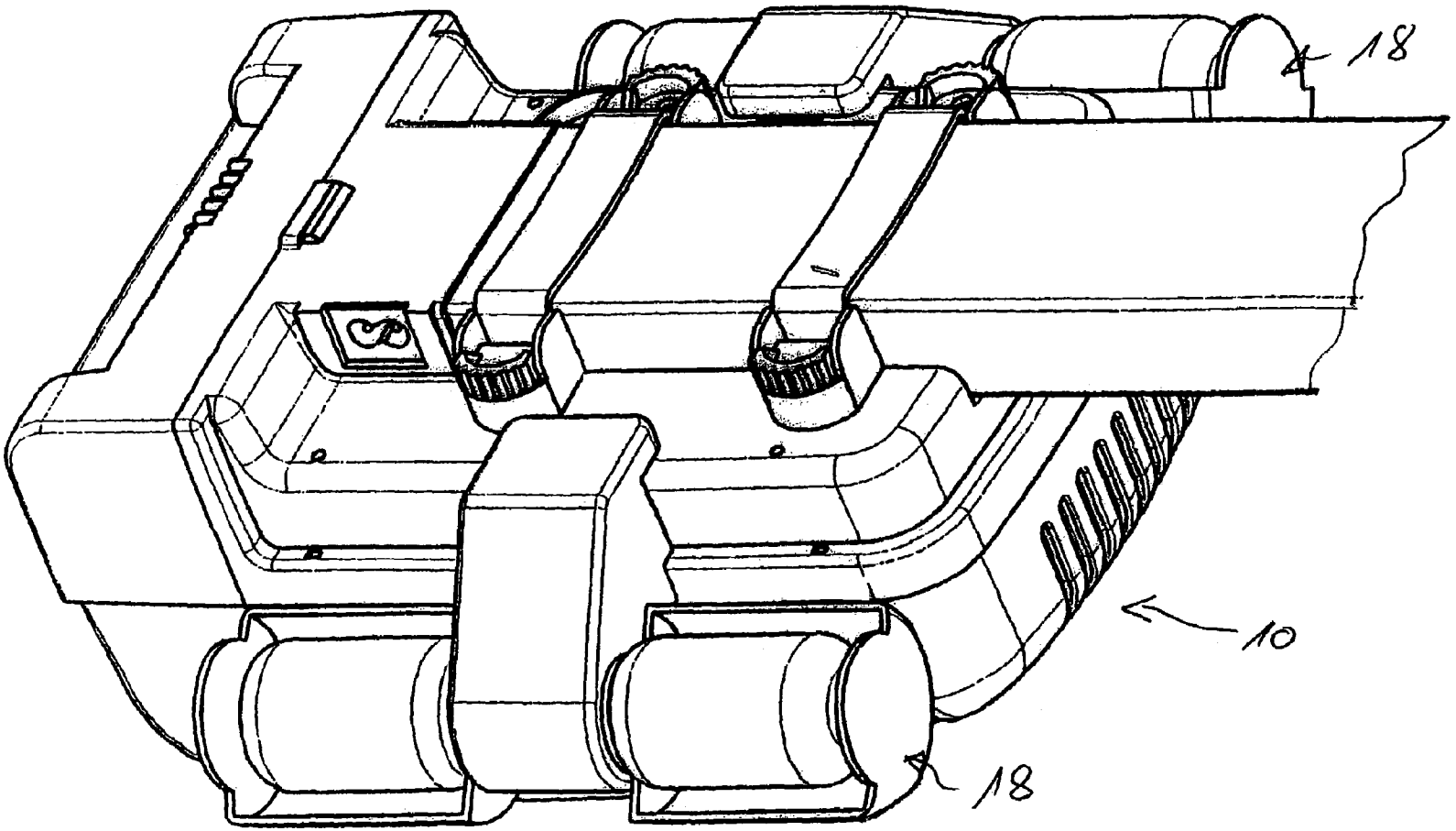
Figure 7:
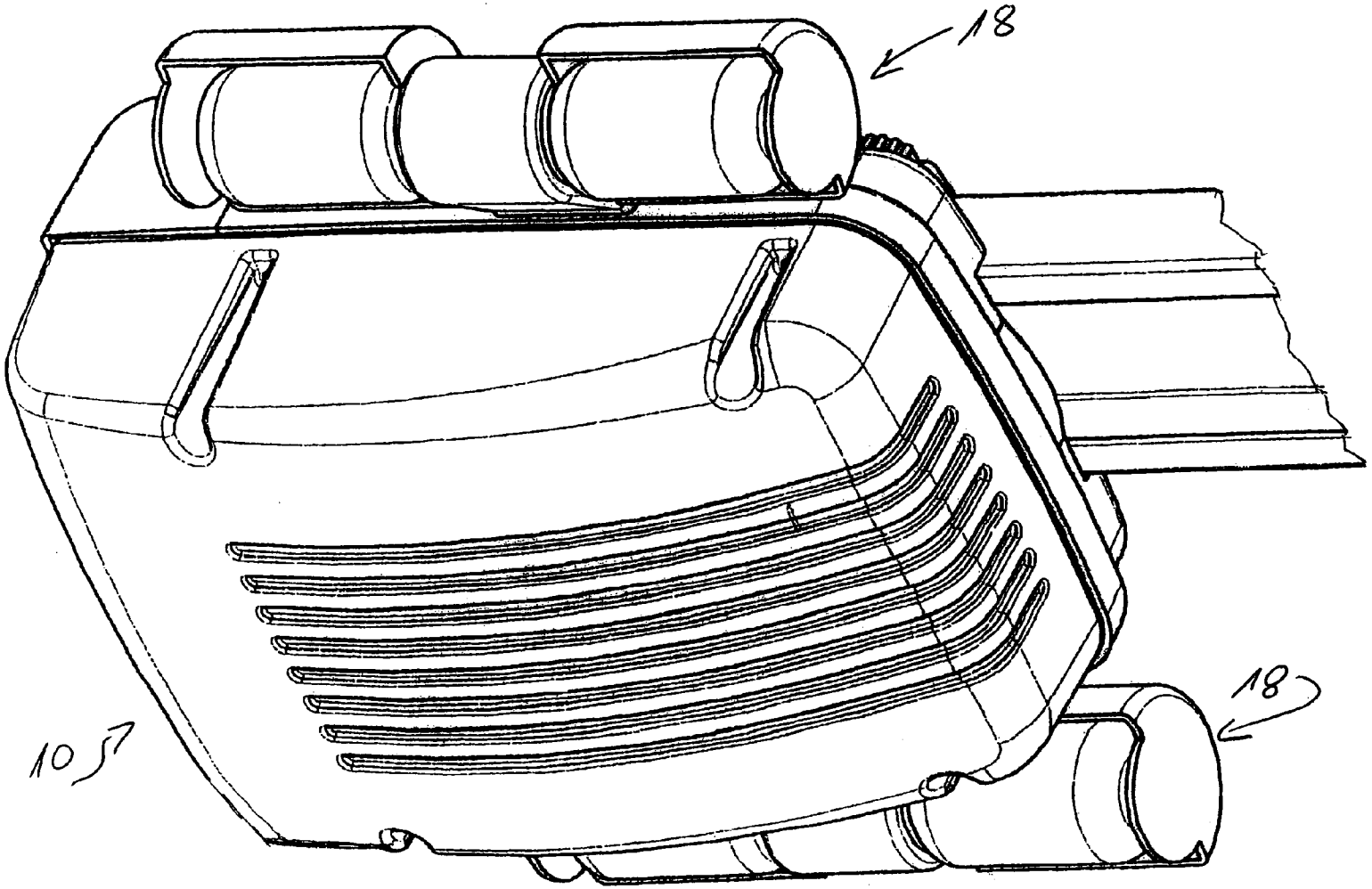
Figure 8:
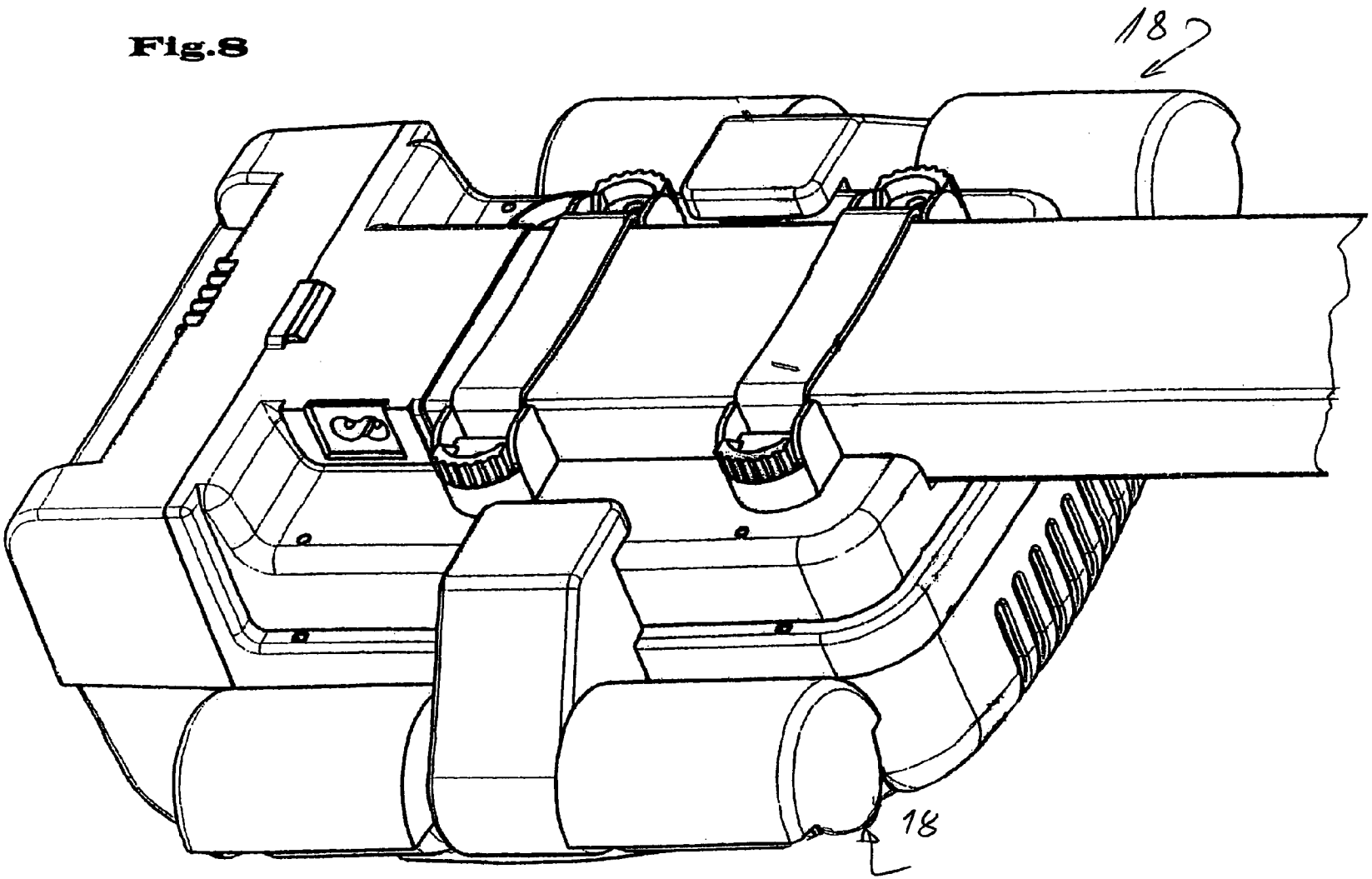

In the diagrams according to FIGS. 4, 5 and 6 on the one hand and FIGS. 7 and 8 on the other, the reflectors 36 and 38 are shown in a respectively different position.

In FIGS. 9 to 12, the light units 18 are shown with a receiver module 40 which can be alternatively used, which also has a mounting point 43 for electrical and mechanical connection and location with a lamp unit 18. Such receiver modules 40 can be arranged at an arbitrary point inside a garage or in the outside area of a garage, for example, on the outside wall of the garage or in the approach to the garage. A flexible modular system for garage lighting and lighting the garage surroundings is hereby provided.

The invention claimed is:

1. A garage door drive comprising:

a housing, and at least one light unit which is attachably and detachably constructed, wherein at least one mounting point for a mechanical and electrical connection of the attachably and detachably constructed at least one light unit is arranged on the housing, and wherein respectively at least one locating projection or respectively at least one corresponding locating recess is arranged on the mounting point on the housing side or on the light unit respectively.

2. The garage door drive according to claim 1, wherein the light unit can be attached on the garage door drive or alternatively on a receiver module with a corresponding mounting point as desired.

3. The garage door drive according to claim 1, wherein the light unit includes a central body with a plug connecting area and two laterally arranged lamps symmetrically distant from the central body.

4. The garage door drive according to claim 3, wherein the light unit can be attached on the garage door drive or alternatively on a receiver module with a corresponding mounting point as desired.

5. The garage door drive according to claim 3, wherein the light unit includes reflectors which partly surround the lamps.

6. The garage door drive according to claim 5, wherein the light unit can be attached on the garage door drive or alternatively on a receiver module with a corresponding mounting point as desired.

7. A garage door drive comprising:

a housing, and at least one light unit which is attachable and detachably constructed, wherein at least one mounting point for a mechanical and electrical connection of the attachable and detachably constructed at least one light unit is arranged on the housing, and wherein the light unit includes a central body with a plug connecting area and two laterally arranged lamps symmetrically distant from the central body.

8. The garage door drive according to claim 7, wherein the light unit can be attached on the garage door drive or alternatively on a receiver module with a corresponding mounting point as desired.

9. The garage door drive according to claim 7, wherein the light unit includes reflectors which partly surround the lamps.

10. The garage door drive according to claim 9, wherein the light unit can be attached on the garage door drive or alternatively on a receiver module with a corresponding mounting point as desired.

* * * * *